US011788329B2

(12) United States Patent
Li et al.

(10) Patent No.: US 11,788,329 B2
(45) Date of Patent: Oct. 17, 2023

(54) LATCH STRUCTURE

(71) Applicant: Ningbo E-Power Engine Technology Co., Ltd., Ningbo (CN)

(72) Inventors: Wenquan Li, Ningbo (CN); Yiqiao Fu, Ningbo (CN)

(73) Assignee: NINGBO E-POWER ENGINE TECHNOLOGY CO., LTD., Ningbo (CN)

( * ) Notice: Subject to any disclaimer, the term of this patent is extended or adjusted under 35 U.S.C. 154(b) by 15 days.

(21) Appl. No.: 17/530,216

(22) Filed: Nov. 18, 2021

(65) Prior Publication Data

US 2022/0396985 A1 Dec. 15, 2022

(30) Foreign Application Priority Data

Jun. 11, 2021 (CN) ..... 202121315213.5
Jun. 11, 2021 (CN) ..... 202130362467.1

(51) Int. Cl.

| | |
|---|---|
| ***E05C 19/06*** | (2006.01) |
| ***E05C 19/02*** | (2006.01) |
| ***E05C 19/12*** | (2006.01) |
| ***E05C 1/10*** | (2006.01) |
| ***E05C 19/10*** | (2006.01) |
| ***E05B 65/52*** | (2006.01) |
| ***E05B 9/00*** | (2006.01) |

(52) U.S. Cl.

CPC ..... *E05C 19/063* (2013.01); *E05C 1/10* (2013.01); *E05C 19/02* (2013.01); *E05C 19/10* (2013.01);

(Continued)

(58) Field of Classification Search

CPC ..... Y10T 292/1075; Y10T 292/0911; Y10T 292/0926; Y10T 292/0934;

(Continued)

(56) References Cited

U.S. PATENT DOCUMENTS 4,179,143 A * 12/1979 Shy ..... E05C 1/04 292/179
4,902,054 A * 2/1990 Swanson ..... E05B 63/244 292/DIG. 22

(Continued)

FOREIGN PATENT DOCUMENTS

DE 2912881 C2 * 3/1988 ..... E05B 65/0007
DE 20 2015 005 752 U1 11/2016

(Continued)

OTHER PUBLICATIONS

Extended European Search Report received for EP Patent Application Serial No. 22151585.1 dated Jul. 5, 2022, 7 pages.

*Primary Examiner* — Kristina R Fulton
*Assistant Examiner* — Steven A Tullia
(74) *Attorney, Agent, or Firm* — Rimon PC

(57) ABSTRACT

A latch structure comprising an elastic pull latch is disclosed. The top of the elastic pull latch includes a latch bar configured with a latch groove. The elastic pull latch also includes an elastic boss that moves in and out of the latch cover of the pull latch. On both sides of a box, an elastic pull latch is provided at the top and a catch groove having a catch affixed to the lower edge is provided at the bottom. When two boxes are stacked together, the catch in the catch groove of the upper box is snapped into the latch groove of the elastic pull latch of the lower box to securely connect the two boxes. When the latch is released, the catch of the upper box blocks the elastic boss of the latch of the lower box to prevent the latch from retracting inwards.

9 Claims, 9 Drawing Sheets

(52) U.S. Cl.
CPC ..... *E05C 19/12* (2013.01); *E05B 9/002* (2013.01); *E05B 65/52* (2013.01)

(58) Field of Classification Search
CPC ..... Y10T 292/0945; Y10T 292/0948; Y10T 292/0951; Y10T 292/0952; Y10T 292/0953; Y10T 292/0956; Y10T 292/096; Y10T 292/0969; Y10T 292/0997; Y10T 292/1014; Y10T 292/1022; Y10T 292/1023; Y10T 292/1024; Y10T 292/1028; Y10T 292/54; Y10T 292/546; E05C 19/063; E05C 19/02; E05C 19/12; E05C 19/10; E05C 1/10; E05C 1/00; E05C 1/004; E05C 1/08; E05C 1/085; E05B 9/002; E05B 65/52; E05B 65/5215; E05B 65/523; E05B 63/18; E05B 63/20; B65D 21/0212; B65D 21/0215; B65D 21/0219; B65D 21/022; B65D 21/0223; B65D 21/0228
USPC ..... 206/509, 511
See application file for complete search history.

(56) References Cited

U.S. PATENT DOCUMENTS 5,518,282 A * 5/1996 Sawada ..... E05B 17/2011 292/252
6,527,309 B1 * 3/2003 Gaydos ..... E05B 65/5276 292/DIG. 22
7,370,891 B1 * 5/2008 Schmitt ..... E05B 17/2053 292/113
8,979,100 B2 3/2015 Bensman et al.
9,393,684 B2 7/2016 Christopher et al.
9,725,209 B1 8/2017 Ben-Gigi
10,583,962 B2 3/2020 Brunner et al.
10,710,770 B2 7/2020 Kogel et al.
10,981,696 B2 4/2021 Brunner et al.
11,008,136 B2 5/2021 Brunner et al.
2005/0001435 A1 * 1/2005 Parker ..... A45C 13/1084 292/116
2006/0208499 A1 * 9/2006 Rusiana ..... E05B 15/101 292/170
2008/0307835 A1 12/2008 Grenier et al.
2014/0028034 A1 * 1/2014 Albers ..... E05C 19/12 292/96
2017/0166352 A1 6/2017 Hoppe et al.
2019/0225371 A1 7/2019 Hoppe et al.
2020/0298392 A1 * 9/2020 Baruch ..... B25H 3/02
2020/0299027 A1 9/2020 Brunner et al.
2021/0039831 A1 2/2021 Brunner et al.
2021/0139197 A1 5/2021 Brunner et al.
2021/0016928 A1 6/2021 Brunner et al.

FOREIGN PATENT DOCUMENTS

EP 3480397 A1 * 5/2019 ..... E05B 13/002
EP 3747603 A1 * 12/2020 ..... B25H 3/02
FR 2871509 A1 * 12/2005 ..... E05B 65/0007

* cited by examiner

LATCH STRUCTURE

RELATED APPLICATIONS

This US utility application claims priority under the Paris Convention to Chinese Application 20211315213.5 filed on Jun. 11, 2021, and Chinese Application 202130362467.1 filed on Jun. 11, 2021, the entire content of both applications being incorporated herein in their entirety.

FIELD OF THE TECHNOLOGY

The present disclosure relates to a latch structure that can be used to separably connect and/or lock two objects together.

BACKGROUND

When objects such as boxes, crates, or pallets that are stacked one above another, adjacent stacked objects can be joined together by a latch to improve the stability of the stacked-up objects. However, when separating the stacked items, the latch structures known in the prior art are inconvenient to unlatch. Usually, the uppermost item must be unlatched from the adjacent item immediately below it by two hands, before it can be released and removed from the stack. This is often inconvenient.

SUMMARY

Accordingly, in view of the above-mentioned defects of prior art latches, the purpose of the present application is to provide an improved latch structure.

The present application discloses a latch structure that can be used on a carrier such as a box or crate. The left and right sides of the cover of the carrier are each provided with an elastic pull latch that can be pulled out. The elastic pull latch has one sidewall that extends over the upper surface of the latch to form a straight edge above the upper surface. The top portion of the straight edge may be referred to as a latch bar and is configured with a latch groove with an inward opening. An elastic boss capable of moving vertically is mounted inside the elastic pull latch. When assembled, the upper end of the elastic boss extends out of the upper surface of the latch. The left and right sides at the bottom of the carrier are each configured with a catch groove, and a catch is provided on the lower edge of the catch groove.

When multiple carriers of the same or similar structures are stacked one above another, a catch at the bottom of the upper carrier of two adjacent carriers is snapped into the latch groove of an elastic pull latch located on the cover of the lower carrier. The bottom side of the catch of the upper carrier touches and depresses the elastic boss of the elastic pull latch of the lower carrier. After the elastic pull latch of the lower carrier is pulled out, the elastic boss rises above and extends out of the upper surface of the latch so it becomes blocked by the catch. As such, the elastic pull latch is held on the outer side of the catch. The elastic pull latch remains in a pulled-out position and is prevented from moving inwards.

In some embodiments, the left and right sides of the cover of a carrier are each provided with a chute with an outward opening. The elastic pull latch is arranged inside the chute with the side wall of the elastic pull latch being exposed outside the carrier. The end of the elastic pull latch that is exposed outside the carrier is also referred to as the outer end of the elastic pull latch.

In some embodiments, the top portion of the straight edge of the side wall is provided with a latch bar, and the latch groove is located on an inner side of the latch bar.

In some embodiments, an upper end of the latch bar has a slope on its inner side.

In some embodiments, when two carriers of the same structure are stacked one above another, on each side of the stacked-up carriers the latch bar of the lower carrier is snapped into the catch groove of the upper carrier and the catch of the upper carrier is snapped into the latch groove of the lower carrier.

In some embodiments, a first spring extending horizontally is fitted inside the elastic pull latch. A stop piece is connected to the first spring and is mounted on the elastic pull latch. The first spring is retained by the stop piece and a side wall of the elastic pull latch. The bottom surface of the elastic pull latch has an elongated through-hole extending horizontally. The stop piece is in sliding-fit with the elongated through-hole and can slide along the elongated through-hole. The lower end of the stop piece extends outside the elongated through-hole. The chute on the upper cover of the carrier has a snap-in hole shaped to match the lower end of the stop piece so that the lower end of the stop piece can be snapped into the snap-in hole. In some embodiments, the elastic pull latch may be configured with multiple first springs, for example two first springs as shown in FIG. 3, and multiple corresponding through-holes.

In some embodiments, a second spring extending vertically is mounted inside the elastic pull latch, for example, on the lower inner surface of the elastic pull latch, and is connected to the elastic boss. The elastic boss may be situated on top of the second spring. The upper surface of the elastic pull latch has an opening allowing the top of the elastic boss to pass through.

In some embodiment, the elastic pull latch is internally provided with an accommodating slot for housing the elastic boss. The lower end of the elastic boss may include a spring recess with a downward opening for housing the second spring.

In some embodiments, the bottom side of the catch of the upper carrier of two adjacent carriers is in contact with and presses onto the top of the elastic boss of the elastic pull latch of the lower carrier. When the elastic pull latch of the lower carrier is pulled outwards, the elastic boss of the elastic pull latch moves outwards. After the elastic boss moves away from the catch and moves upwards from underneath the bottom of the catch, the catch blocks the elastic boss so that the elastic boss is held on the outer side of the catch and the latch is prevented from retracting inwards.

In some embodiments, the carrier may be a box, a trunk, a crate, or a pallet.

One of the advantages of the latch structure disclosed in the present application is that, when stacked carriers need to be separated, each elastic pull latch can be pulled out using one hand and will remain in a pulled-out state without retracting so that other elastic pull latches can be released one by one. In this way, stacked up carriers can be released and unlatched "single-handedly," literally speaking, making the latch more convenient to use.

BRIEF DESCRIPTION OF THE DRAWINGS

These and other features of the present disclosure will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

Figure 1:
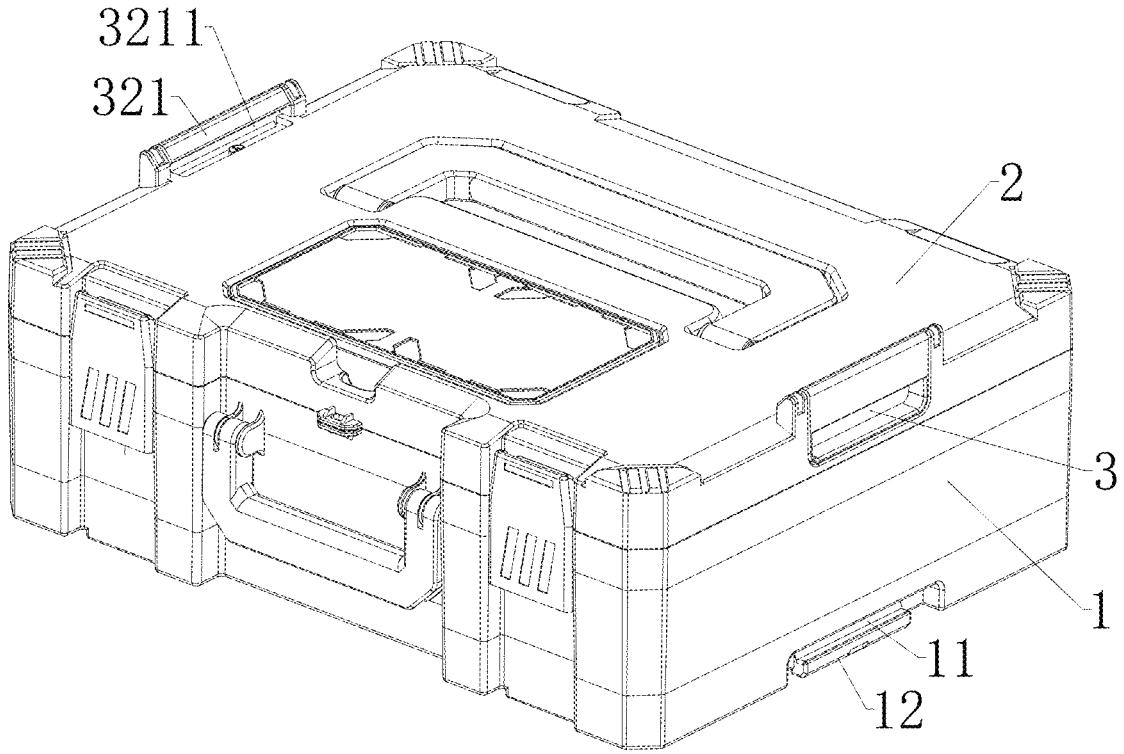
FIG. 1 is a schematic diagram of a carrier configured with a latch of the present application.
Figure 2:
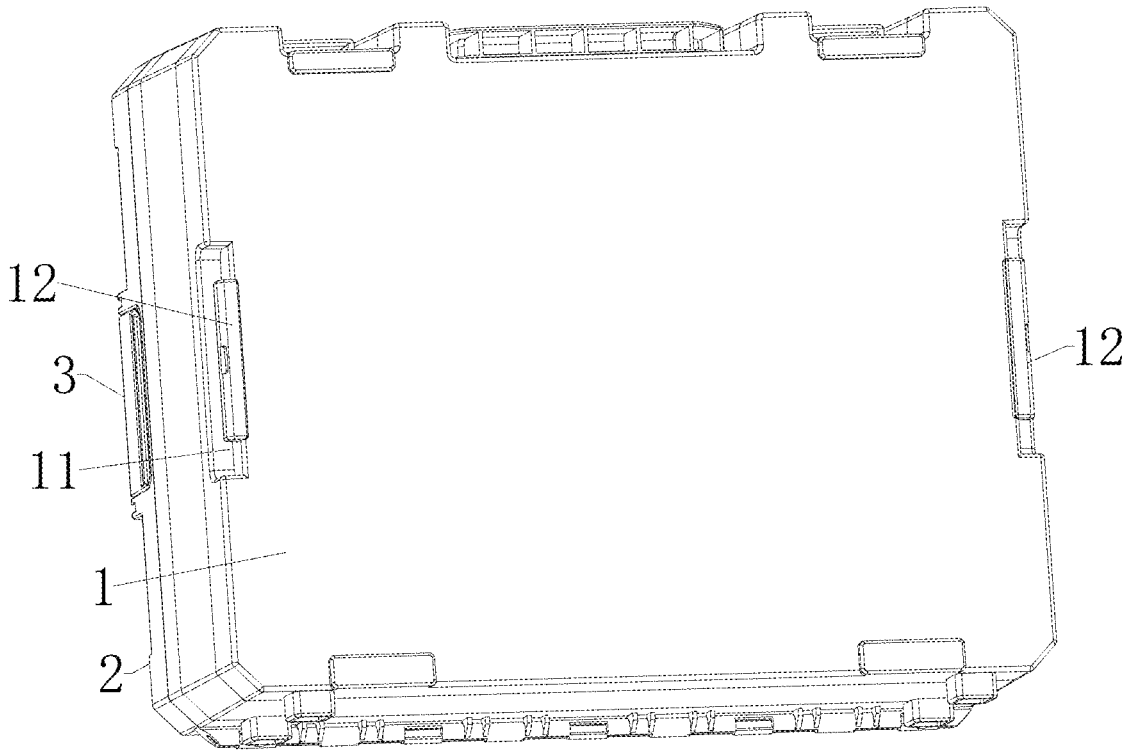
FIG. 2 is a schematic diagram showing the bottom of a carrier provided with a latch of the present application.

In the drawings: 1: box body; 11: catch groove; 12: catch; 2: (carrier) cover; 21: chute; 211: snap-in hole; 3: elastic pull latch; 31: base; 311: elongated through-hole; 32: pull latch cover; 321: latch bar; 3211: latch groove; 3212: slope; 322: opening; 323: accommodating slot; 33: elastic boss; 331: spring recess; 34: first spring; 35: stop piece; 36: second spring.

DETAILED DESCRIPTION

Embodiments of the disclosure are described more fully hereinafter with reference to the accompanying drawings, in which preferred embodiments of the disclosure are shown. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

In referring to FIG. 1-FIG. 9, the present application discloses a latch structure that can be used on a carrier such as a trunk or a box. These terms may be used interchangeable herein and are not intended to limit the manner of how the disclosed device is used or the scope of the disclosure. The left and right sides of the cover 2 of the carrier are each provided with an elastic pull latch 3 that can extend outwards when pulled. The top of the elastic pull latch 3 is a latch bar 321, which has a latch groove 3211 with an inward opening. An elastic boss 33 capable of moving vertically is mounted in the elastic pull latch 3. The top of the elastic boss 33 extends out of the upper surface of the carrier. The left and right sides of the bottom of the carrier are each provided with a catch groove 11. A catch 12 resembling a rectangular block or a ridge is provided on the lower edge of the catch groove 11.

When at least two carriers of the same or similar structure are stacked one above another, the catch 12 at the bottom of an upper carrier is snapped into the latch groove 3211 of the elastic pull latch 3 on the upper cover 2 of the lower carrier, and the bottom surface of the catch 12 on the upper carrier touches and depresses the elastic boss 33 of the pull latch 3 on the lower carrier. After the elastic pull latch 3 of the lower carrier is pulled out, the elastic boss 33 moves upwards and is then blocked by the catch 12. The pull latch 3 is being prevented from retracting inwards and is held on the outer side of the catch 12. See FIG. 8 and FIG. 9 for reference.

When one carrier is stacked above another carrier, the catch 12 on the bottom of the upper carrier is snapped into the latch groove 3211 of the elastic pull latch 3 located on the cover 2 of the lower carrier. The bottom side of the catch 12 depresses the elastic boss 33. See FIG. 6 and FIG. 7. After the elastic pull latch 3 of the lower carrier is pulled out, the elastic boss 33 is held on the outer side of the catch 12 because the catch 12 blocks the elastic boss 33 preventing the pull latch 3 from moving inwards.

Figure 5:
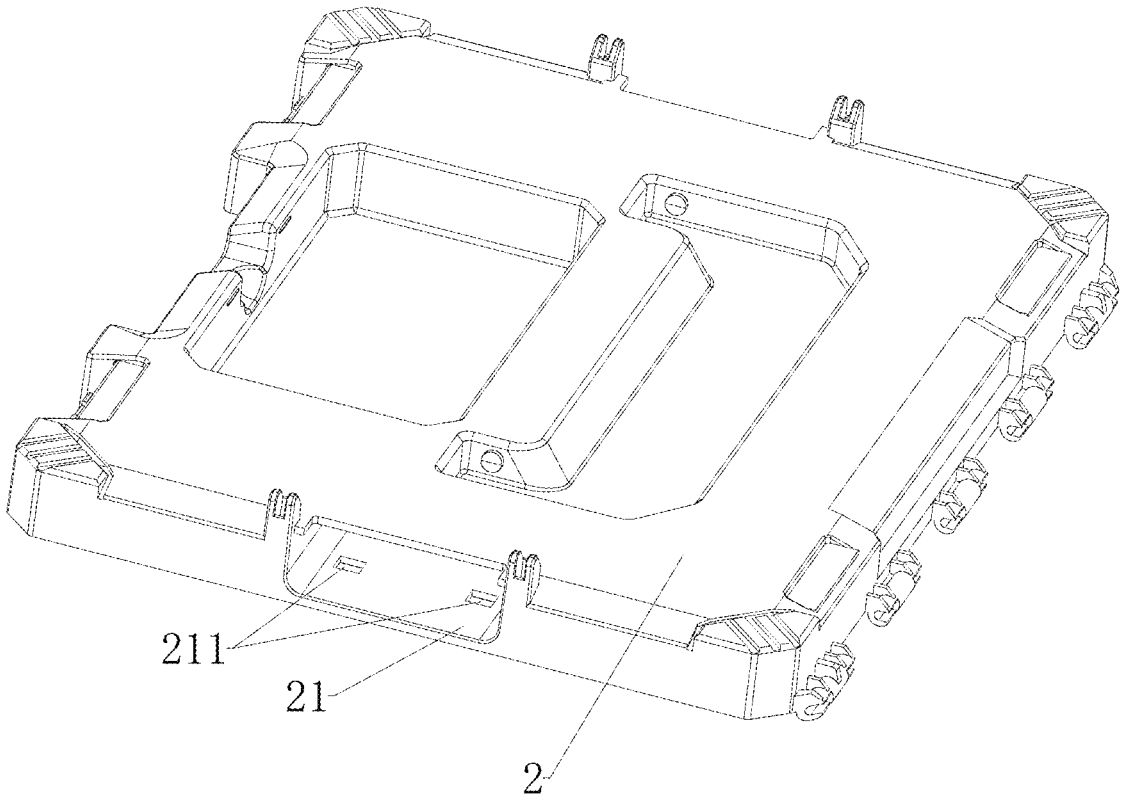
FIG. 5 is a schematic diagram of a carrier cover configured with a pull latch of the present application.

As shown in FIG. 1 and FIG. 5, the left and right sides of the upper cover 2 of a carrier are each provided with a chute 21 with an outward opening. The elastic pull latch 3 is arranged inside the chute 21 on the cover 2. The outer end of the elastic pull latch 3 remains outside the chute 21.

Figure 3:
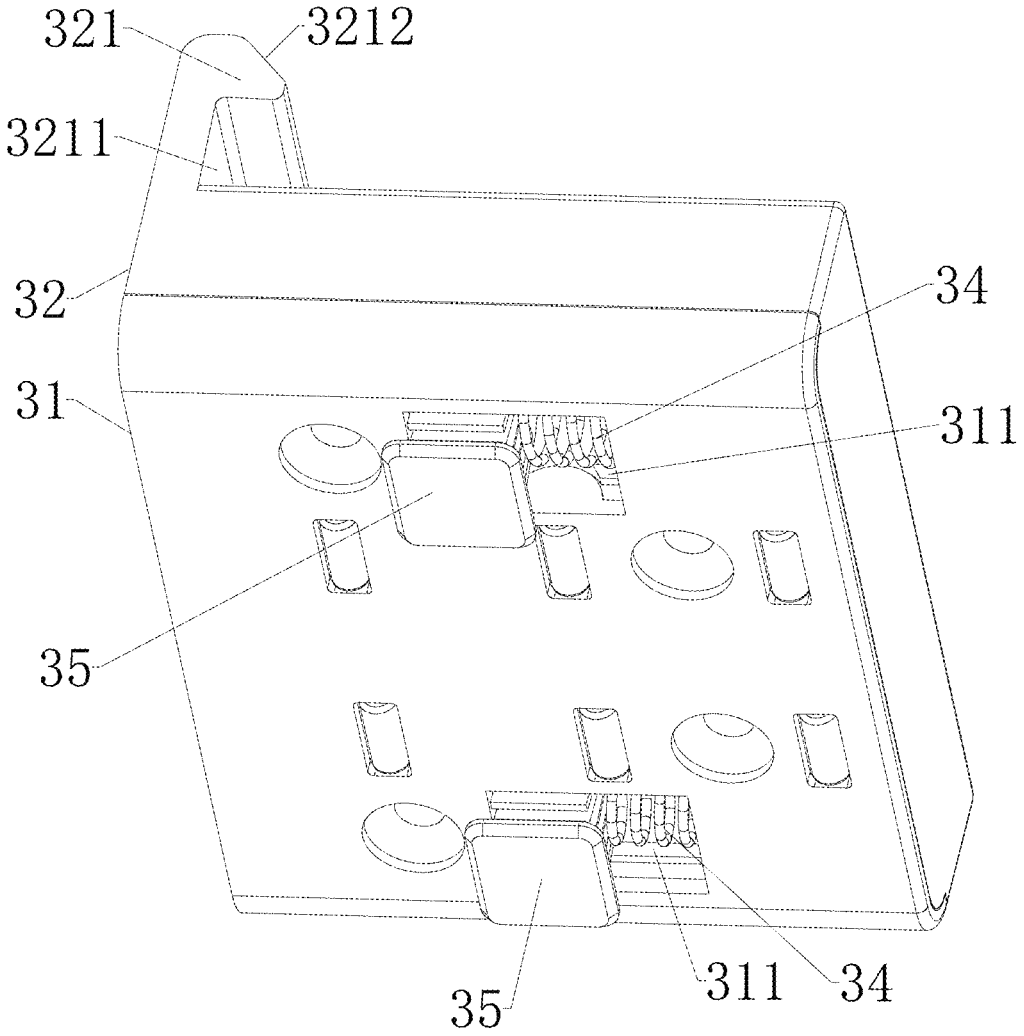
FIG. 3 is a schematic diagram of an overall structure of an elastic pull latch of the present application.
Figure 7:
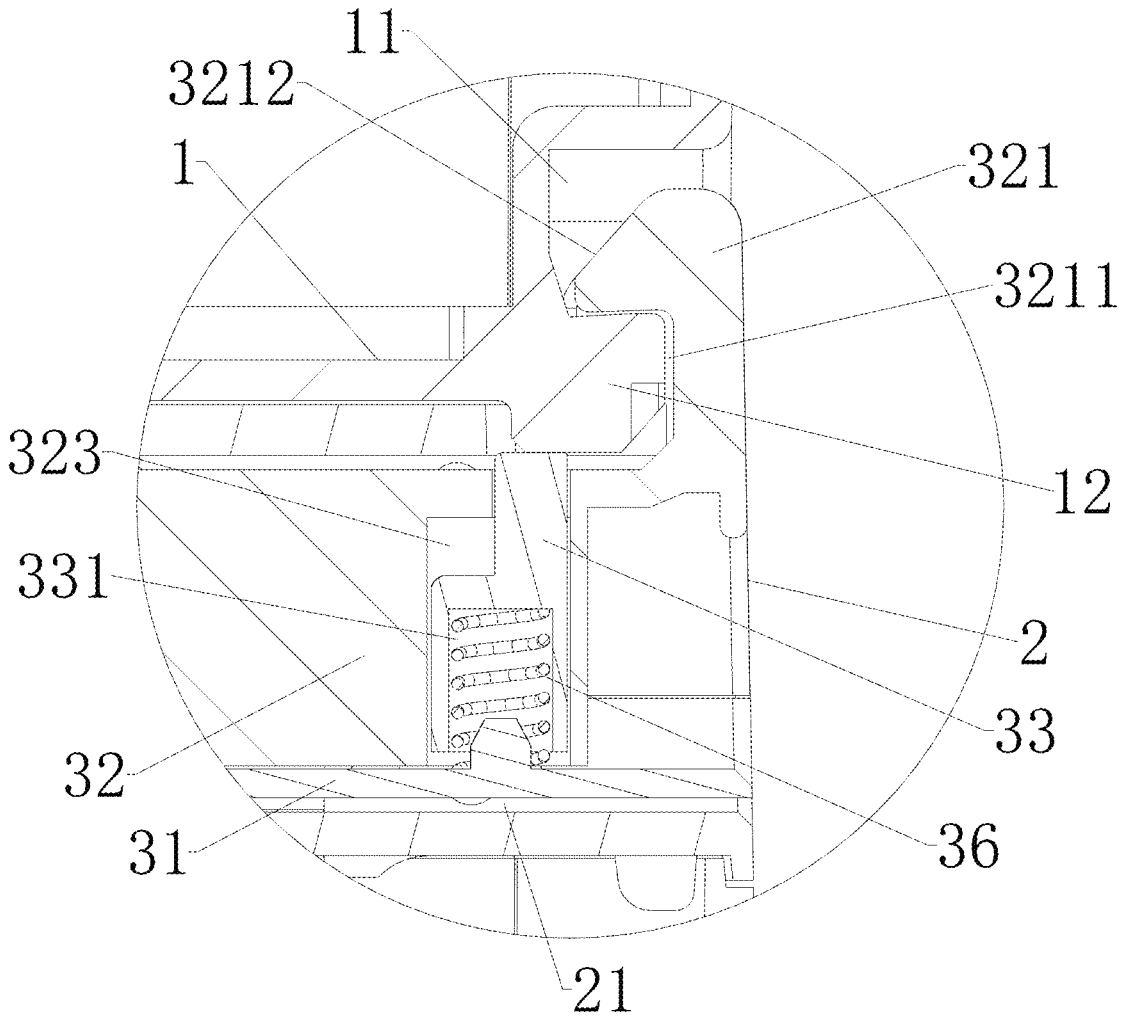
FIG. 7 is an enlarged view of region A in FIG. 6.

As shown in FIG. 3, a top portion of the outer end of the elastic pull latch 3 includes a latch bar 321 that sticks outside the pull latch cover 32. The latch groove 3211 is located on the inner side of the latch bar 321. The upper end of the latch bar 321 has a slope 3212 on the inner side, the side that faces the interior of the pull latch cover 32. In some embodiments, the slope 3212 matches the slope of the catch groove 11 as shown in FIG. 7. When one box is stacked above another box, the latch bar 321 of the lower box is snapped into the catch groove 11 of the upper box, as shown in FIG. 7. Because the upper end of the latch bar 321 is shaped into a slope 3212, when the catch 12 of the upper box is in contact with the slope 3212 of the latch bar 321 of the lower box, the elastic pull latch 3 is pushed outwards to snap the catch 12 into the latch groove 3211 of the pull latch and snap the latch bar 312 into the catch groove 11.

Figure 4:
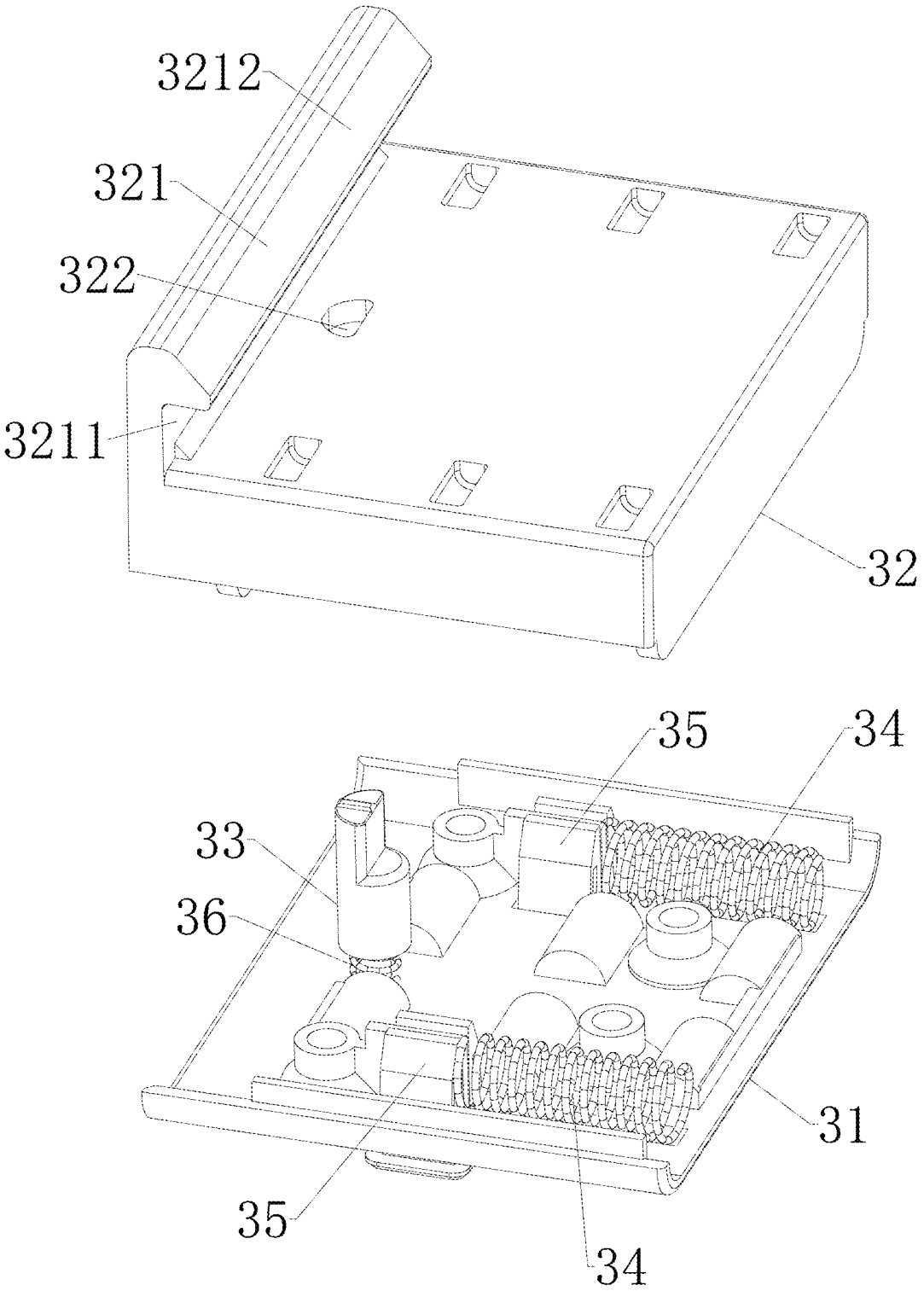
FIG. 4 is a schematic diagram of an internal structure of a pull latch of the present application.

As shown in FIGS. 3-5, two first springs 34 extending horizontally are mounted in the elastic pull latch 3. Two stop pieces 35 are mounted in the elastic pull latch 3. Each of the first springs 34 is retained between a stop piece 35 and an inner wall of the elastic pull latch 3. The bottom portion of the elastic pull latch 3 has two elongated through-holes 311 extending horizontally. The stop pieces 35 are in sliding-fit with the elongated through-holes 311 and can slide through the through-holes 311. The lower end of each stop piece 35 passes through and comes out of the elongated through-holes 311. The chute 21 on the upper cover 2 of the box is internally provided with a snap-in hole 211 shaped to match the lower end of the stop piece 35. The lower end of the stop piece 35 can be snapped into the snap-in hole 211. When the elastic pull latch 3 is pulled outwards, the stop piece 35 stays inside the snap-in hole 211 and the first spring 34 becomes compressed.

As shown in FIG. 4, a second spring 36 extending vertically is mounted in the elastic pull latch 3 and the elastic boss 33 is situated on the second spring 36. The upper surface of the elastic pull latch 3 has an opening 322, allowing the top of the elastic boss 33 to pass through. In the embodiments shown in FIGS. 7 and 9, the elastic pull latch 3 is internally provided with an accommodating slot 323. The elastic boss 33 is arranged in the accommodating slot 323. The lower end of the elastic boss 33 includes a spring recess 331 with a downward opening. The second spring 36 is housed in the spring recess 331.

Figure 6:
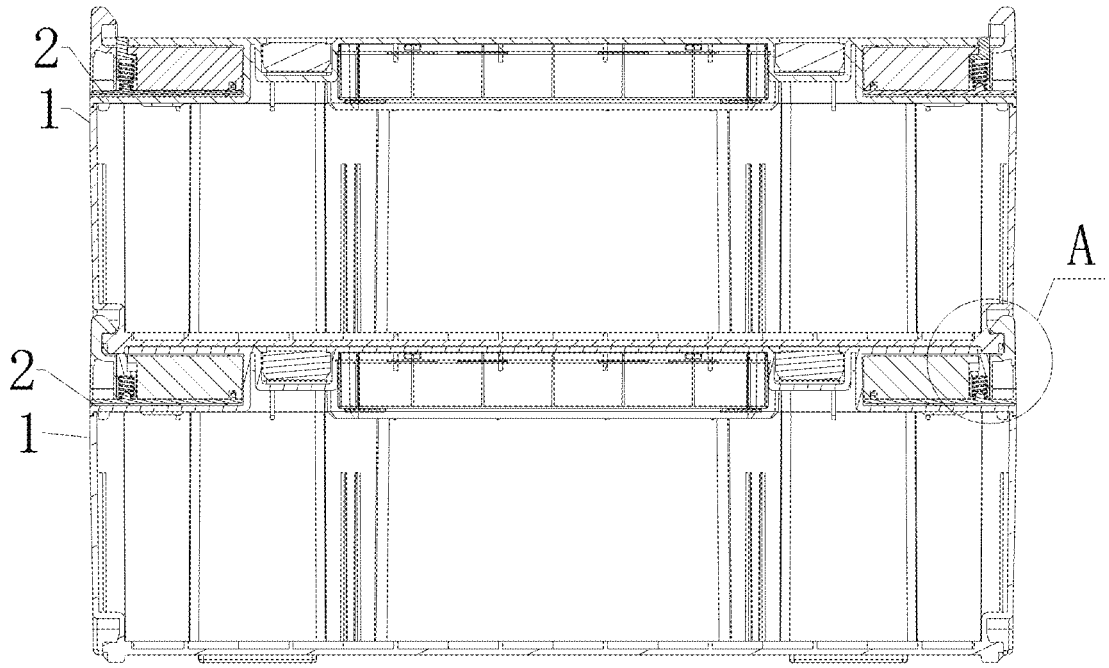
FIG. 6 is a schematic diagram showing two boxes joined together by two latches of the present application.
Figure 8:
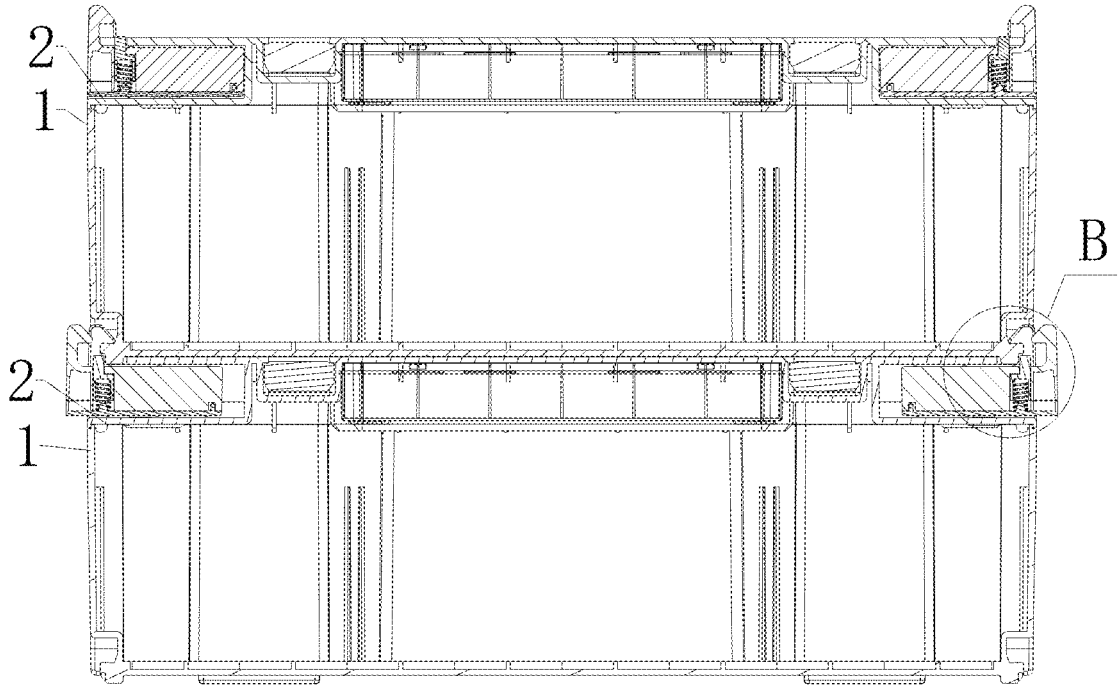
FIG. 8 is a schematic diagram showing two boxes unlatched from each other when the latches are released.
Figure 9:
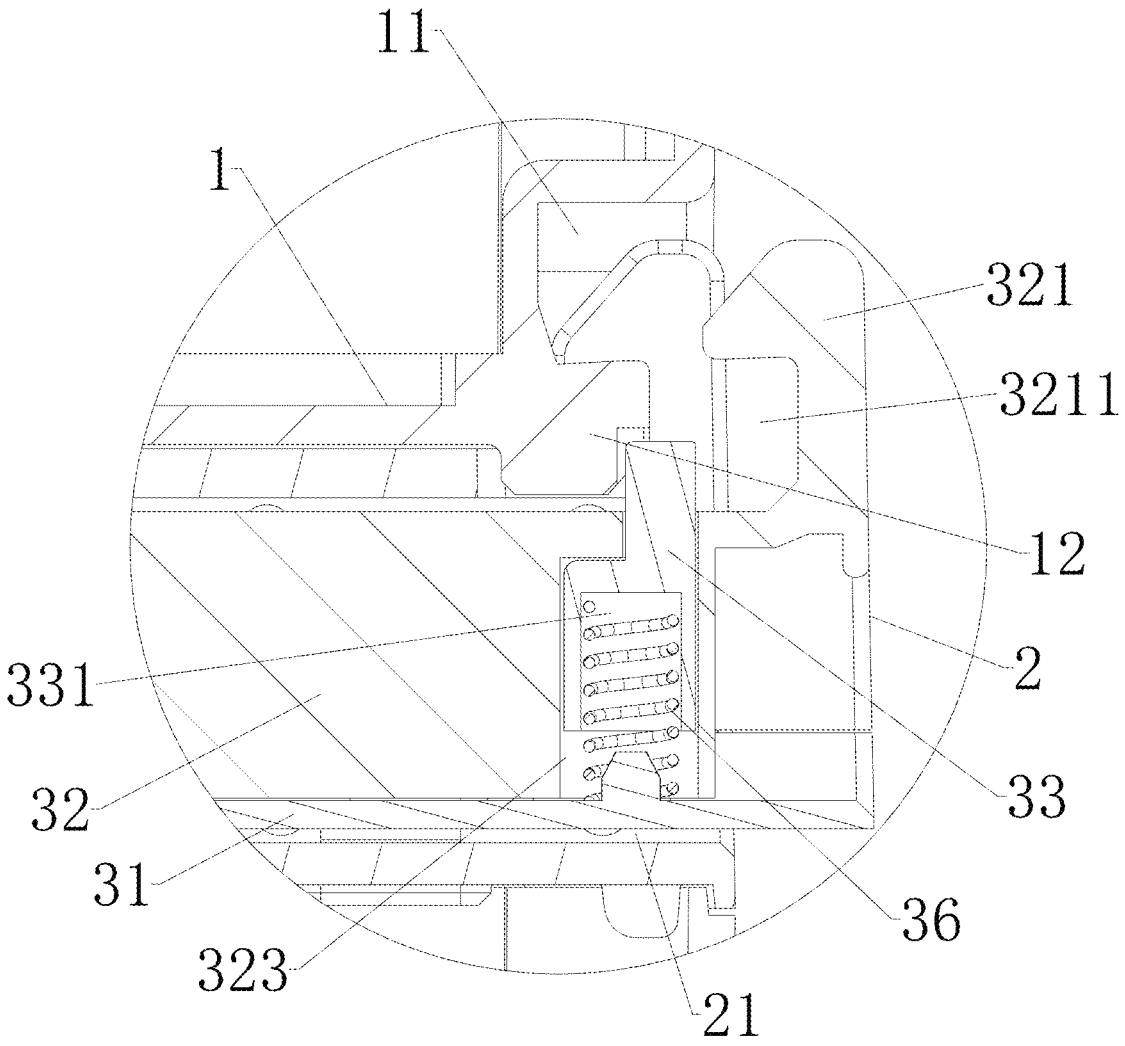
FIG. 9 is an enlarged view of region B in FIG. 8.

In FIG. 6 and FIG. 7, two boxes are stacked one on top of the other. The boxes are securely latched together using two elastic pull latches 3. When in a locked position, the bottom of the catch 12 of the upper box is in contact with the top of the elastic boss 33 of the lower box, and the second spring 36 underneath the elastic boss 33 is compressed. When the latch is released as shown in FIG. 8 and FIG. 9, the elastic pull latch 3 is pulled outwards and the elastic boss 33 moves outwards. After the elastic boss 33 moves away from the catch 12, the elastic boss 33 is pushed upward by the compressed second spring 36. See FIG. 9. When in a released position, the elastic boss 33 is held on the outer side of the catch 12 and the elastic pull latch 3 remains in a pulled-out state.

As shown in FIGS. 3 and 4, the elastic pull latch 3 includes a base 31 and a pull latch cover 32 on top of the base 31. The accommodating slot 323 (see FIG. 7), the opening 322, and the latch bar 321 are arranged in or on the pull latch cover 32. The elongated through-hole or through-holes 311 are formed in the base 31.

In some embodiments, when a plurality of boxes are stacked one above another, the catch 12 of an upper box can directly snap into the latch groove 3211 of a lower box, as shown in FIG. 7 and FIG. 8. When the stacked boxes need to be separated, the elastic pull latches 3 can be released one by one, instead of being released one pair at a time by both hands. In this way, the stacked boxes can be separated and removed more conveniently. After the upper box is removed, the elastic boss 33 in the elastic pull latches 3 of the lower box is no longer held by the catch 12. The elastic pull latch 3 of the lower box is automatically reset by the compressed first springs 34.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. A latch for connecting a first object with a second object; comprising:

an elastic pull latch, wherein the elastic pull latch includes a latch cover, a base, an elastic boss mounted on the base and is configured to move vertically, and a latch bar that extends above the latch cover and is configured with a latch groove; and a catch that is affixed inside a catch groove;

wherein the elastic pull latch is installed on the first object and the catch groove is provided on the second object with the catch affixed to the lower edge of the catch groove;

wherein the latch cover is configured with an opening to accommodate the top of the elastic boss, and the top of the elastic boss is configured to move through the opening of the latch cover;

wherein when the catch is snapped into the latch groove of the elastic pull latch and the top of the elastic boss is pressed into the opening by the catch, the latch is fastened to securely connect the first object and the second object; and wherein when the latch is released, the elastic boss moves out of the opening and is blocked by the catch to prevent the elastic pull latch from retracting inwards.

2. The latch structure of claim 1, wherein when the latch is fastened, the latch bar is snapped into the catch groove.

3. The latch structure of claim 2, wherein the elastic pull latch is arranged inside a chute on the first object; and an outer end of the elastic pull latch is exposed outside the chute on the first object.

4. The latch structure of claim 3, wherein the latch bar is located on a top portion of the outer end of the elastic pull latch, and the latch groove is located on an inner side of the latch bar.

5. The latch structure of claim 4, wherein an upper end of the latch bar has a slope shape on an inner side.

6. The latch structure of claim 3, wherein one or more first springs extending horizontally are mounted in the elastic pull latch, a stop piece is attached to each of the one or more first springs and is further mounted in the elastic pull latch, each of the first springs is retained between the stop piece and an inner wall of the elastic pull latch;

wherein the base of the elastic pull latch is configured with one or more elongated through-holes extending horizontally, each stop piece is in sliding fit with each elongated through-hole with a lower end of each stop piece passing through the elongated through-hole; and wherein the chute has one or more snap-in holes, each shaped to match the lower end of the stop piece to allow the lower end of the stop piece to be snapped into the snap-in hole.

7. The latch structure of claim 1, wherein the elastic pull latch is internally provided with an accommodating slot for housing the elastic boss; wherein the lower end of the elastic boss has a spring recess with a downward opening; and wherein the second spring is arranged in the spring recess.

8. The latch structure of claim 1, wherein when the latch is fastened, a bottom portion of the catch is in contact with a top portion of the elastic boss; wherein when the elastic pull latch is pulled outwards, the elastic boss moves outwards; and wherein after the elastic boss moves away from the bottom portion of the catch, the elastic boss moves upwards and the elastic boss is held by the catch on the outer side of the catch.

9. The latch structure of claim 1, wherein the first object and the second object are boxes stacked on top of each other.

* * * * *